United States Patent [19]

Lydie

[11] 4,204,348

[45] May 27, 1980

[54] RIPPER ATTACHMENT FOR EARTH-WORKING EQUIPMENT

[76] Inventor: Phillip E. C. Lydie, 2288 Foothill Dr., Vista, Calif. 92083

[21] Appl. No.: 949,869

[22] Filed: Oct. 10, 1978

[51] Int. Cl.[2] ..... E02F 3/76

[52] U.S. Cl. ..... 37/117.5; 172/699

[58] Field of Search ..... 37/103, 117.5, DIG. 3; 299/67; 172/699, 700, 713

[56] References Cited

U.S. PATENT DOCUMENTS

| | | | |
|---|---|---|---|
| 1,237,610 | 8/1917 | Brenno | 172/699 X |
| 2,783,699 | 3/1957 | Kelley | 172/699 X |
| 3,596,996 | 5/1969 | Carter | 37/103 |
| 3,702,712 | 11/1972 | Cairns | 37/117.5 X |
| 3,778,111 | 12/1973 | Ciofani | 299/67 |
| 4,041,624 | 8/1977 | Fryrear | 37/117.5 |

*Primary Examiner*—E. H. Eickholt

*Attorney, Agent, or Firm*—Frank D. Gilliam

[57] ABSTRACT

A ripper tool having a generally inverted "Y" shaped arrangement for use with earth-working equipment such as backhoes, excavator buckets, tractors, etc. The tool comprises a straight shank including means for sturdy attachment to the earth-working equipment and two teeth angled out from said shank towards the ground, the angle between said teeth being from about 38° to 62°. This bifurcated angled arrangement has been found to be both more effective and longer wearing than single tooth rippers or rippers using two or more parallel teeth.

7 Claims, 6 Drawing Figures

RIPPER ATTACHMENT FOR EARTH-WORKING EQUIPMENT

BACKGROUND OF THE INVENTION

This invention relates in general to earth working equipment and, more specifically, to an improved ripper tool for use with excavating equipment.

Conventional backhoes, using a digging bucket, often encounter poor soil conditions making digging very difficult. Often the ground to be worked is rocky, frozen or simply very well-packed and dense, such as compacted adobe, decomposed granite roads, etc. In such cases, some means must be provided to break up the hardened ground before a backhoe bucket or other excavating means can be used to cmplete the excavation.

Backhoe buckets or scoops often have a plurality of short teeth along the bucket edge. Since a number of cutting edges contact the ground at the same time, penetration into hard ground is very limited. Attachments having one or a few longer teeth are sometimes used to improve digging effectiveness.

A wide variety of cutting and ripping attachments have been designed for use with or attachment to backhoes or other excavating means. In order to concentrate the penetrating or earth breaking force of the ripper, many prior art devices utilize a single ripper tooth as the earth breaking attachment. While often effective, a single tooth only penetrates the ground over a relatively narrow area. Stresses induced in the single tooth and in the means attaching it to the earth-working equipment often result in premature failure. A single tooth also tends to wear rapidly and require frequent replacement.

Using two or a few long parallel teeth has resulted in greater wear resistance, but decreased ripping effectiveness. In general, a single tooth gives greatest penetration but a short effective life while plural teeth provide a longer useful life with lower efficiency.

Thus, there is a continuing need for a ground ripping tool for excavating equipment which combines effective ripping with long wearing characteristics.

It is, therefore, an object of this invention to provide a ripping tool which more rapidly breaks up hard, dense soil.

Another object of this invention is to provide a ground ripping tool having a longer useful life.

A further object of this invention is to provide a ground ripping tool adapted for use with a variety of earth-working machines.

SUMMARY OF THE INVENTION

The above objects, and others, are obtained by a ripper tool having an approximately "Y" shaped arrangement, the shank of said tool having means for attachment to an earth-working machine, such as a backhoe bucket, and each tooth terminating in an earth engaging tip. Preferrably the two teeth lie at an angle of about 30° to 62° to each other, equally on each side of the shank. Optimum results have been obtained at an angle of about 50°. Preferrably, each tip has a chisel-like shape, the edge lying approximately perpendicular to the plane of the plate-like teeth.

BRIEF DESCRIPTION OF THE DRAWING

Details of the invention, and of a preferred embodiment thereof, will be further understood upon reference to the drawing, wherein.

DETAILED DESCRIPTION OF THE INVENTION

Figure 1:
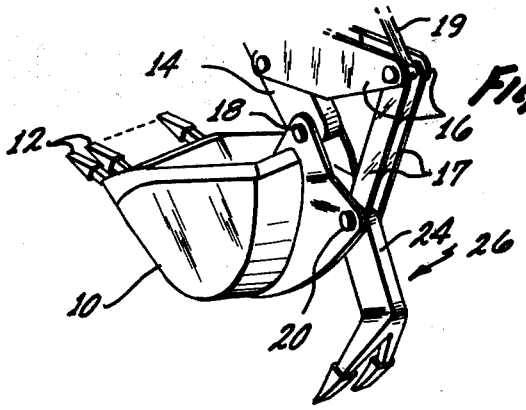
FIG. 1 is a schematic perspective representation of a backhoe bucket to which the earth ripper of this invention is attached.
Figure 2:
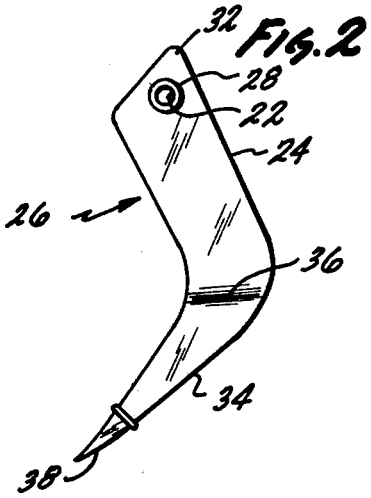
FIG. 2 is a side elevation view of the earth ripper tool, partially cut-away for clarity.
Figure 3:
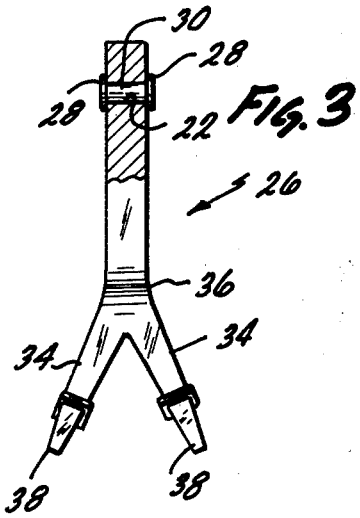
FIG. 3 is a front elevation view of the earth ripper tool.

Referring now to FIG. 1, there is seen a perspective view, from the back, of an excavation bucket 10 of the sort which could be carried by a piece of conventional earth-working equipment (not shown) such as a backhoe. While bucket 10 may have a series of teeth 12 along the front edge of the bucket, as discussed above such teeth are useful only with relatively soft earth. Bucket 10 is supported on the earth-working machine by a bar 14. A articulated arm, consisting of a pair of spaced parallel plates 16 and spaced parallel bars 17, is connected to operating means 19 movably attached to the machine. The articulated arm is moved by means 19 to pivot bucket 10 around pin 18 between bucket 10 and bar 14. The pin 20 which fastens bars 17 to bucket 10 passes through a hole 22 (as seen in FIGS. 2 and 3) in shank 24 to secure the ripper tool 26 to bucket 10.

A pair of rings 28 (FIGS. 2, 3 and 4) are secured, such as by welding, around each end of hole 22. The rings have a sufficient thickness to provide a snug fit between bars 17 and may be hardened, if desired, to provide a long wearing bearing surface. Bushings 30 (FIG. 3) of selected internal diameter may be placed in hole 22 to accommodate different diameter pins 20.

Ripper tool 26 is prevented from rotating about pin 20 by the upper end 32 of shank 24 which bears against the end of rod 14, as seen in FIG. 1. The shape of end 32 will be selected to fit the specific bucket 10 or other device with which the ripper tool 26 is to be used.

A pair of angularly displaced ripper teeth 34 are secured to shank 24 along a line 36 by any suitable means, such as welding. Of course, the entire tool 26 could be forged and/or machined from a single piece of steel. Each tooth 34 preferrably has a flat plate configuration as shown, tapering to a point at the lower end. Of course, teeth 34 could be more rounded, triangular, or any other suitable configuration.

While the sharp tips of teeth 34 could be formed as part of the teeth, for longest wear replaceable tip inserts 38 are preferred. Inserts 38 may be steel, tungsten carbide or any other suitable material. Inserts 38 may have stems (not shown) inserted into holes in the ends of teeth 34, may be welded in place, etc.

While inserts 38 may have any suitable shape, best results have been obtained with wedge or chisel shaped tips having an edge approximately perpendicular to the plane of the plate-shaped teeth 34.

Figure 4:
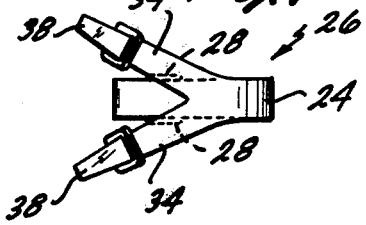
FIG. 4 is a plan view, looking upwardly from ground level, of the earth ripper tool.

The angular relationship of teeth 34 has been found to be critical to obtaining optimum performance. While the reason this ripper tool 26 is superior to prior tools having single teeth or spaced parallel teeth is not fully understood, it is thought that at times both teeth 34 work simultaneously together and at other times the assembly rocks slightly, so that each tooth alternately and cyclically digs in. Thus, this tool automatically adjusts to ground hardness. In any event, best results with longest wear is obtained where the angle between teeth 34 (as seen in FIG. 4) is from about 30° to 62°, with optimum results at about 50°, each tooth at an equal angle to the centerline symbolized by main shank 24 in FIG. 4.

Figure 5:
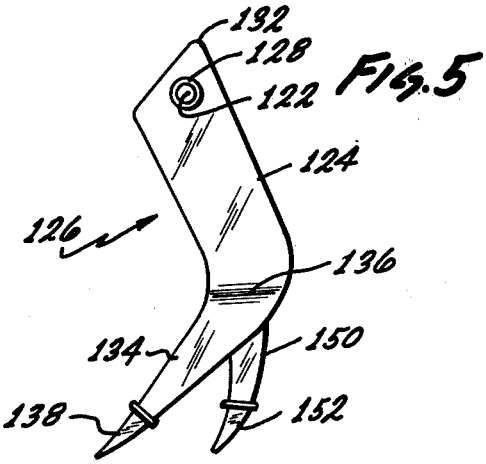
FIG. 5 is a front elevation view of a second embodiment of the earth ripper tool.
Figure 6:
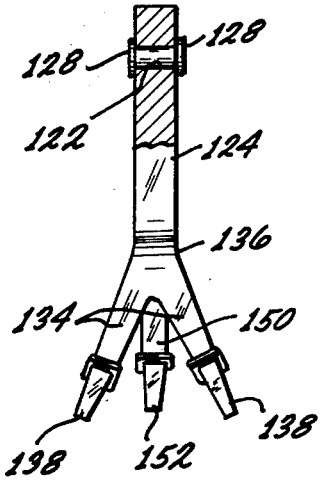
FIG. 6 is a side elevation view of the tool embodiment of FIG. 5.

An alternative embodiment of the ripper of this invention is shown in FIGS. 5 and 6. In some cases, it is desirable to rip a relatively narrow slot in the ground during part of an earthmoving operation. As seen in FIGS. 5 and 6, a third tooth 150 may conveniently be included, mounted centrally between first and second teeth 134 on ripper tool 126. Ripper tool 126 is basically similar to tool 26 shown in FIGS 1–4, being mountable on a bucket or other device by a pin passing through hole 122 between rings 128, with main shank 124 and shoulder 132 engaging the support means. Each main and central tooth preferrably has a hardened tooth insert 138 and 152, respectively.

Either first and second teeth 134 together or third tooth 150 can be independently brought into ground contact by moving the support means in a manner rotating tool 126 about the pin in hole 122. With the tool rotated forward, only third tooth 150 will engage the ground, while rotating the tool rearwardly will bring first and second teeth 134 into ground engagement. While it is possible to bring all three teeth into ground contact at the same time with two teeth in advance of the third tooth, this is generally not desirable, since this arrangement would have many of the multi-tooth ripper problems discussed above.

While specific orientations and overall configuration details are provided in the above description of a preferred embodiment, these may be varied within the scope of this invention with similar results. For example, the location of hole 22, the shapes of shank 24 and shank end 32, and the overall curve of the tool may be caried to fit the specific piece of earth-working equipment with which the ripper tool is to be used. In general, any mounting arrangement may be used where, by operating the conventional earth-working machine, teeth 34 can be brought into forceful contact with the ground at angles between about 20° and 90°.

Other variations, applications and ramifications of this invention will occur to those skilled in the art upon reading this disclosure. These are intended to be included within the scope of this invention, as defined in the appended claims.

What is claimed is:

1. A ripper tool for use with earth-working equipment, said tool comprising:

first and second downwardly extending teeth attached to said shank in an approximately inverted "Y" shaped relationship;

said first and second teeth having chisel tips with edges approximately perpendicular to the planes of said teeth and adapted to lie approximately parallel to the ground when in use;

each tooth lying at an equal angle to said shank;

the angle between said teeth being from about 30° to 62°;

whereby said earth-working equipment may be operated to bring said teeth into forceful contact with the ground at an angle between teeth and ground of from about 20° to 90° so that said tool may rock slightly about the shank permitting each tooth to alternately and cyclically dig deeper into the ground.

2. The ripper tool according to claim 1 wherein said tool is secured to a ground excavating means on said earth-working equipment by a pin passing through a hole in said shank and the end of said shank opposite said first and second teeth contacts a portion of said ground excavating means to prevent rotation of said tool about said pin.

3. The ripper tool according to claim 1 wherein the angle between said first and second teeth is about 50°.

4. The ripper tool according to claim 1 further including a third downwardly extending tooth centrally located between and behind said two teeth whereby either said first and second teeth together or said third tooth alone may be independently brought into contact with ground.

5. In an earth-working machine having a bucket for excavating the ground, a supporting bar pivotably attached to said bucket and an articulated arm for pivoting said bucket, said arm comprising spaced parallel plates and a pin securing said plates to said bucket, the improvement comprising:

a ripper tool having a shank portion;

first and second angled teeth secured to a first end of said shank portion in an approximately "Y" shaped arrangement;

said teeth having chisel tips with edges approximately perpendicular to the planes of said teeth and adapted to lie approximately parallel to the ground when in use;

a hole in said shank portion through which said pin passes when said shank is in place between said plates;

a shoulder at the second end of said shank adapted to bear against the end of said supporting bar to prevent rotation of said tool about said pin;

said first and second teeth lying at equal angles to said shank; and the angle between said first and second teeth being from about 30° to 62°;

whereby as said teeth are moved across the ground in digging engagement therewith, said tool may rock slighlty about the tool shank so that said teeth may alternately and cyclically dig deeper into the ground.

6. The improvement according to claim 5 wherein the angle between said first and second teeth is about 50°.

7. The improvement according to claim 5 further including a third downwardly extending tooth centrally located between and behind said two teeth whereby either said first and second teeth together or said third tooth alone may be independently brought into contact with the ground.

* * * * *